US005727736A

United States Patent [19]

Tryon

[11] Patent Number: 5,727,736

[45] Date of Patent: Mar. 17, 1998

[54] SPRAY APPLICATOR WITH AIR SHUT-OFF VALVE

[75] Inventor: James A. Tryon, Seattle, Wash.

[73] Assignee: Homax Products, Inc., Bellingham, Wash.

[21] Appl. No.: 512,937

[22] Filed: Aug. 9, 1995

[51] Int. Cl.[6] ..... B05B 7/30

[52] U.S. Cl. ..... 239/345; 239/353; 239/414; 239/526

[58] Field of Search ..... 239/345, 353, 239/414, 526, 525

[56] References Cited

U.S. PATENT DOCUMENTS

| | | | |
|---|---|---|---|
| 1,650,686 | 11/1927 | Binks | 239/414 |
| 2,305,269 | 12/1942 | Moreland | 239/345 |
| 2,887,274 | 5/1959 | Swenson | 239/371 |
| 3,236,459 | 2/1966 | McRitchie | 239/416 |
| 3,945,571 | 3/1976 | Rash | 239/152 |
| 4,078,578 | 3/1978 | Buchholz | 137/614 |
| 4,364,521 | 12/1982 | Stankowicz | 239/346 |
| 4,411,387 | 10/1983 | Stern et al. | 239/345 |
| 4,438,884 | 3/1984 | O'Brien et al. | 239/600 |
| 4,850,387 | 7/1989 | Bassill | 137/212 |
| 4,863,104 | 9/1989 | Masterson | 239/345 |
| 4,955,545 | 9/1990 | Stern et al. | 239/320 |
| 4,961,537 | 10/1990 | Stern | 239/348 |
| 4,989,787 | 2/1991 | Nikkel et al. | 239/346 |
| 5,069,390 | 12/1991 | Stern et al. | 239/320 |
| 5,150,880 | 9/1992 | Austin, Jr. et al. | 251/149 |
| 5,188,295 | 2/1993 | Stern et al. | 239/320 |

FOREIGN PATENT DOCUMENTS

| | | |
|---|---|---|
| 2336186 | 7/1977 | France . |
| 210449 | 5/1909 | Germany . |

*Primary Examiner*—Lesley D. Morris

*Attorney, Agent, or Firm*—Michael R. Schacht; Hughes, Multer & Schacht, P.S.

[57] ABSTRACT

A fluid dispensing device having a housing assembly, a conduit assembly, and a shut-off valve assembly. The conduit assembly engages the housing assembly to form a first valve assembly that prevents fluid material from reaching a mixing location in a closed configuration and allows fluid material to reach the mixing location in an open configuration. The shut-off valve assembly comprises a valve housing and a valve member disposed within a valve chamber defined by the valve housing. When the conduit assembly is in the closed configuration, pressurized air within the valve chamber forces the valve member into a closed position against the valve housing to prevent pressurized air from reaching the mixing location. When the conduit assembly is in the open configuration, it displaces the valve member into an open position in which pressurized air can flow from the valve chamber, through the conduit assembly, and to the mixing location. When both fluid material and pressurized fluid are present at the mixing location, the pressurized fluid carries the fluid material against a surface to be coated.

41 Claims, 8 Drawing Sheets

SPRAY APPLICATOR WITH AIR SHUT-OFF VALVE

TECHNICAL FIELD

The present invention relates to spray applicators for surface coatings such as texture material, paint, and the like, and particularly spray applicators that develop a spray using a separate source of compressed air.

The present invention relates to spray applicators that develop a spray of material such as texture material or paint by mixing the material to be sprayed with a stream of pressurized air. The pressurized air atomizes the material being sprayed and carries it to a wall, ceiling, or other surface to be coated.

The present invention is of particular importance in the context of applying texture coatings, and that application will be described in detail herein. However, it should be clear that the principles of the present invention may be applied to other materials such as paints and the like; the scope of the present invention should thus be determined by the claims appended hereto and not the following detailed description.

At present, there are two commonly employed methods of applying a texture material to a wall surface or the like. The traditional method is to provide a hopper of texture material above a gun-like body. The texture material is gravity fed from the hopper into a mixing location where the material encounters a stream of pressurized air. More recently, texture material has been placed in aerosol containers or small hand pump devices configured to dispense the texture material. This later method is appropriate only for small patching jobs, and is not appropriate for the texturing of entire walls and ceilings.

The present invention relates to the more traditional hopper gun-type spray applicators that employ a separate source of pressurized air.

Most hopper-type spray applicators include a valving arrangement that prevents the product to be dispensed from reaching the mixing area where it is introduced into the stream of pressurized air. Usually, this is accomplished by introducing the texture material into a product chamber adjacent to the mixing location. A nozzle from which the airstream exits engages a housing in a closed position and is retracted from the housing into an open configuration to allow the texture material to flow from the product chamber into the mixing area.

In many cases, the air is allowed to free run the entire time the spray applicator is in use. In other arrangements, a separate air valve is provided to turn off the air source when the nozzle is in the closed position to conserve air.

In particular, in situations where entire rooms are to be textured, a dedicated air compressor is employed to provide a continuous stream of air to the hopper gun. In this case, free running air is not a problem. In other situations, such as small touch-up jobs and the like, a finite source of pressurized air is used. For example, the pressurized air may be contained in an air tank or the like to make the system more portable.

When a finite air source is employed, it is highly desirable to shut off the air when the spray gun is not applying texture material because free running air will soon drain the air tank. Numerous schemes have been employed to shut off the air when the spray gun is not spraying texture material.

For example, the assignee of the present invention has sold a texture gun in which the air passed through a compressible tube upstream of the nozzle. When the nozzle was in its forward position (that is, the texture material was prevented from reaching the mixing location), a trigger member of the hopper gun acted on the compressible tube to prevent air flow. When the trigger was pulled to retract the nozzle, the trigger no longer pinched the compressible tube and therefore allowed the pressurized air to flow through the nozzle. This scheme proved not to be entirely reliable and created sequencing problems between the shut-off of the nozzle valve and that of the air valve. The sequencing problems resulted in a poor spray pattern developing at the end of the spray period.

Another scheme for shutting off air is to provide an external valve upstream of the entire hopper gun. Immediately prior to pulling the trigger, the external valve is opened to allow air to flow. Then, immediately after the trigger is released, the external valve is turned off. This process yields good spray texture patterns for the entire spraying period, but requires two hands and is somewhat awkward during use.

Another spray texture gun having an internal air shut-off valve is shown in U.S. Pat. No. 4,863,104 to Masterson. The Masterson patent discloses a shut-off valve in which a housing for the air shut-off valve also acts as a stop that is longitudinally adjustable to limit the travel of the trigger to set the coverage rate at which the material is dispensed. The air shut-off valve disclosed in the Masterson patent is unreliable in that it stays open unintentionally approximately 20% of the time. Further, the product embodying the Masterson patent exhibits a sequencing problem in which the nozzle valve opens before the air valve, causing a poor spray pattern at the beginning of the spray period.

The applicant is also aware of the following references.

U.S. Pat. No. 2,887,274 to Swenson discloses a traditional hopper gun without an internal air shut-off valve.

U.S. Pat. No. 4,364,521 to Stankowicz discloses a conventional hopper gun having an external shut-off valve for its air source.

U.S. Pat. No. 4,438,884 to O'Brien et al. discloses a quick disconnect nozzle for air conduits and the like.

U.S. Pat. No. 3,945,571 to Rash discloses a hopper gun having an external shut-off valve.

U.S. Pat. No. 1,650,686 to Binks discloses a spray gun employing an internal air shut-off valve.

U.S. Pat. No. 2,305,269 to Mooreland discloses a conventional hopper gun that does not use an internal air shut-off valve.

U.S. Pat. No. 3,236,459 to McRitchie discloses a relatively conventional hopper gun device that does not appear to disclose an internal air shut-off valve.

French Pat. 2,336,186 appears to disclose a conventional hopper gun that does not employ an internal air shut-off valve.

German Pat. 210449 appears to disclose a hopper gun having an internal air shut-off valve that is actuated by the trigger.

U.S. Pat. No. 4,989,787 to Nickel et al. discloses a spray gun that uses Venturi effect to develop a spray of material. This is a fairly complex device that discloses as part of an air check valve the use of a free-floating ball that is moved into opened and closed positions by differing air pressures on either side thereof.

U.S. Pat. No. 4,850,387 to Basil, U.S. Pat. No. 4,078,578 to Buchholz, and U.S. Pat. No. 5,150,880 to Austin, Jr. et al. all disclose valve configurations.

OBJECTS OF THE INVENTION

From the foregoing, it should be clear that one primary object of the present invention is to provide improved spray texturing devices of the type that use a hopper gun and an external source of pressurized air.

Another more specific object of the present invention is to provide a hopper gun spraying device that contains a favorable mix of the following characteristics:

(a) does not allow air to free flow when texture material is not being dispensed;

(b) accurately and reliably opens an air shut-off valve at substantially the same time as a nozzle valve is opened to allow texture material into a mixing location;

(c) comprises simple construction and reduced parts to decrease manufacturing costs.

SUMMARY OF THE INVENTION

These and other objects are obtained by the present invention, which comprises a trigger actuated hopper gun having a valve housing defining a valve chamber and a free-floating valve member disposed within the valve chamber. When the trigger is pulled rearward, an actuator member extends into the valve chamber and displaces the valve member rearwardly to allow air to flow through a nozzle where it is mixed with material to be dispensed. When the trigger member is in a forward position, the valve member is no longer rearwardly displaced and pressurized air forces the valve member to block passage of fluid through the nozzle.

The present invention can be made with very few parts, each of which can be very easily and inexpensively manufactured. Additionally, these parts can be consistently manufactured in a manner that prevents sequencing problems between opening of a nozzle valve and opening of an air shut-off valve. Accordingly, the present invention allows air to flow only when material is being dispensed but does so in a manner that results in very good spray patterns during the time product is being dispensed.

The valve member is preferably a sphere. Because it is free-floating within the valve chamber, the spherical valve member does not engage a valve seat portion of the valve housing in the same configuration each time. Thus, over time the valve does not distort either the valve member or the valve seat in the same location. This increases the reliability of the spray gun.

Additionally, the present invention preferably comprises a trigger stop located in the handle portion of the gun. This trigger stop engages one of a plurality of surfaces on the trigger depending on the trigger stop's location in the handle. A detent arrangement is provided to lock the trigger stop in various locations corresponding to the various surfaces on the trigger. The amount of product being dispensed can thus be controlled in a predictable manner with a highly reliable, easily manufactured assembly.

With the arrangement of the present invention, only one spring need be provided, which also reduces the cost and increases the reliability of the product constructed in accordance with the present invention.

BRIEF DESCRIPTION OF THE DRAWINGS

Referring now to the drawings, depicted at FIG. 1 is a first embodiment of a hopper gun spray texturing device constructed in accordance with, and embodying, the principles of the present invention.

DETAILED DESCRIPTION

Figure 1:
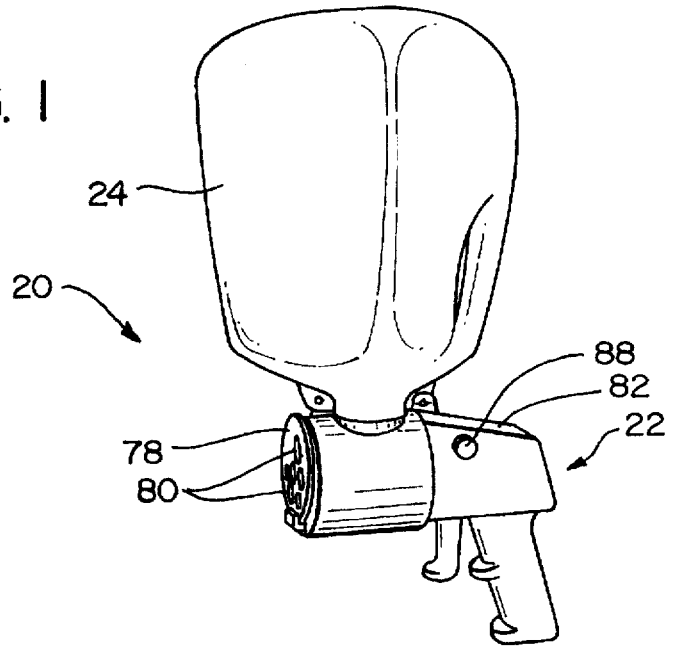
Figure 2:
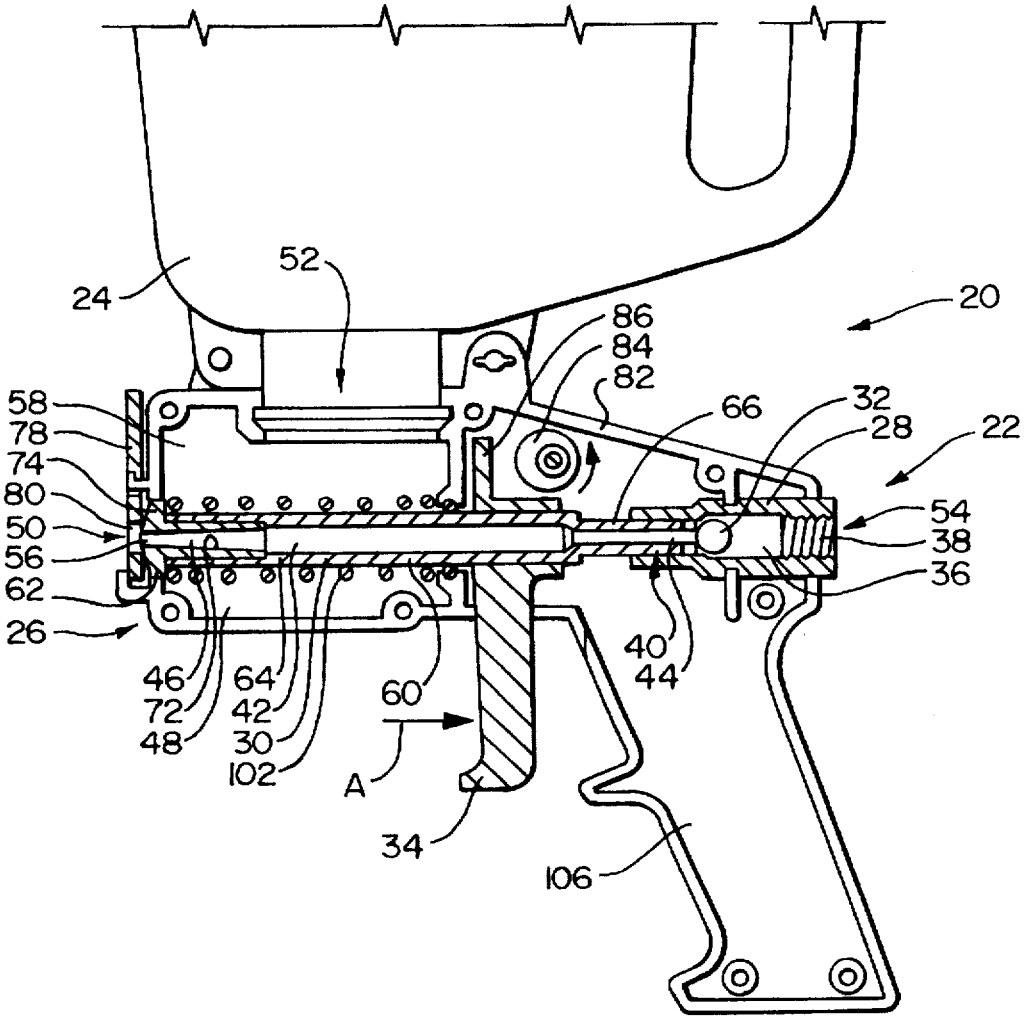
FIG. 2 is a side, cut-away view depicting the overall construction of the hopper gun shown in FIG. 1.

Referring initially to FIGS. 1 and 2, depicted at 20 therein is a hopper gun for spraying texture material and the like that is constructed in accordance with, and embodies, the principles of the present invention. The hopper gun 20 comprises a dispensing assembly 22 and a hopper 24. The hopper 24 is conventional and is adapted to be secured to an upper portion of the dispensing assembly 22 in a manner that will be described in more detail below.

The dispensing assembly 22 comprises a main housing assembly 26, a valve housing 28, a conduit assembly 30, a valve member 32, and a trigger member 34.

The valve housing defines a valve chamber 36 having a valve inlet 38 and a valve outlet 40. The conduit assembly 30 defines a fluid passageway 42 having an inlet portion 44 and a nozzle portion 46.

The valve housing 28 and conduit assembly 30 are mounted to the main housing assembly 26. In particular, the main housing assembly 26 defines a main chamber 48 and nozzle, product, and fluid openings 50, 52, and 54. The valve housing 28 is mounted to the main housing assembly 26 such that it extends through the fluid opening 54. The conduit assembly 30 is mounted to the main housing assembly such that the nozzle portion 46 of the fluid passageway 42 is adjacent a mixing location 56 adjacent to the nozzle opening 50.

The valve housing 28 and conduit assembly 30 are arranged such that the valve outlet 40 and inlet portion 44 of the fluid passageway 42 are in fluid communication with each other. Thus, as will be described below, pressurized fluid introduced into the valve chamber 36 will flow through the fluid passageway 42 to the mixing location 56.

The texture material is stored in the hopper 24 before it is dispensed. The hopper 24 is attached to the main housing assembly 26 such that texture material within the hopper 24 flows through the product opening 52, into a product chamber portion 58 of the main chamber 48, and to the mixing location 56. Pressurized air flowing through this mixing location 56 mixes with the texture material at the mixing location and carries this material out of the hopper gun 20 in a spray that deposits the texture material on a surface as desired.

Figure 3:
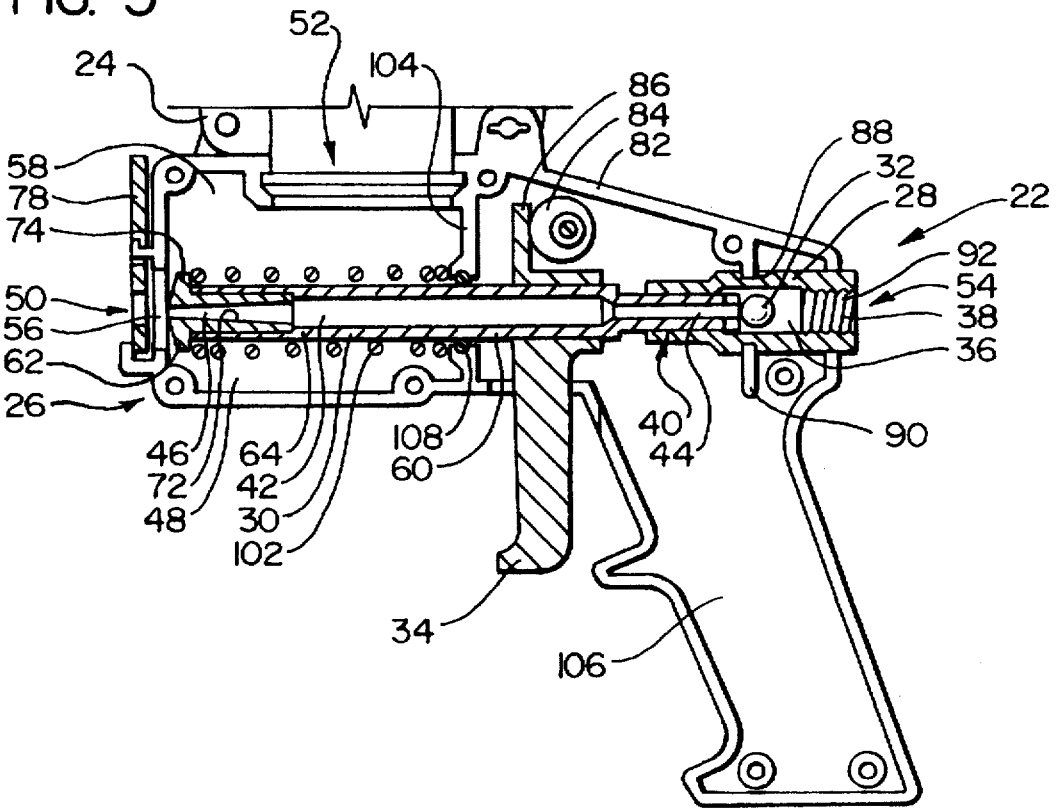
FIG. 3 is the same as FIG. 2 except that the trigger is shown in a rearward position.

By comparing FIGS. 2 and 3, it can be seen that movement of the trigger member 34 in a direction shown by arrow A in FIG. 2 moves the conduit assembly 30 backwards from a closed configuration shown in FIG. 2 to an open configuration shown in FIG. 3. In the closed configuration, texture material cannot flow from the product chamber 58 into the mixing location 56. But in the open configuration, texture material may flow from the product chamber 58 into the mixing location 56.

Figure 4:
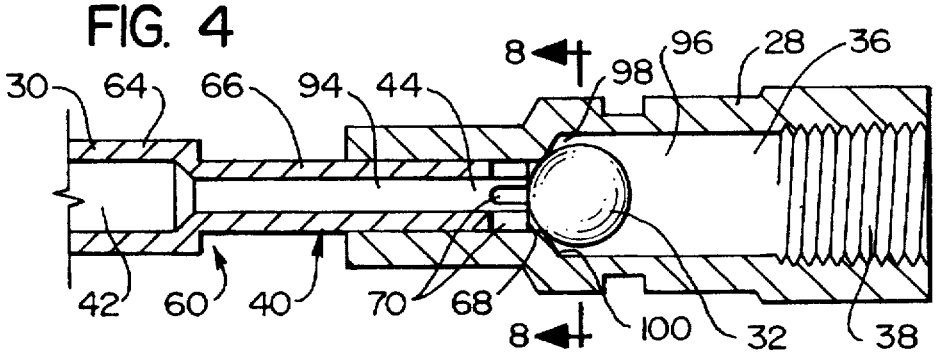
FIGS. 4 and 5 show details of operation of an air shut-off valve of the spray gun shown in FIG. 1.
Figure 5:
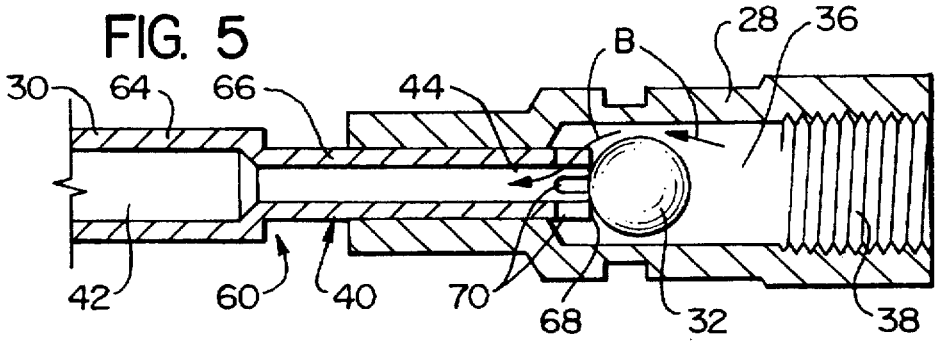

Additionally, referring now to FIGS. 4 and 5, when the conduit assembly 30 is in the closed configuration, pressurized air entering the valve inlet 38 acts on the valve member 32 to maintain this valve member 32 in a closed position in which the valve member 32 engages the valve housing 28 to prevent passage of air out of the valve chamber 36 through the valve outlet 40. But in the open configuration, the conduit assembly 30 engages the valve member 32 to displace this valve member 32 into an open position as shown in FIG. 5. When the valve member 32 is in the open position, pressurized air within the valve chamber 36 may flow out of the valve outlet 44 and into the fluid passageway 42 through the inlet portion 44 thereof.

Accordingly, when the conduit assembly 30 is in the closed configuration, texture material cannot enter the mixing location 56 and air does not flow through the fluid passageway 42. But when the trigger member 34 is pulled to displace the conduit assembly 30 into the open configuration, texture material flows into the mixing location where it is mixed with pressurized air flowing out of the nozzle portion 46 of the fluid passageway 42.

With the foregoing discussion in mind, the following discussion will present the details of construction and operation of several structures that implement the present invention.

Referring initially to FIGS. 2 and 3, it can be seen that the exemplary conduit assembly 30 described therein comprises an actuator member 60 and a nozzle member 62. The actuator member 60 has a forward portion 64 and an engaging portion 66. The forward portion 64 is adapted to receive the nozzle member 62, while the engaging portion 66 is adapted to extend into the valve outlet 40 in an essentially fluid-tight manner.

As perhaps best shown in FIGS. 4 and 5, an engaging end 68 of the actuator member 60 is the portion of the conduit assembly that engages the valve member 32. Therefore, the actuator member 60 should be sized and dimensioned such that, when the conduit assembly is in the open configuration, the engaging end 68 does not contact the valve member 32 but is immediately adjacent thereto as shown in FIG. 4. When the conduit assembly 30 is in the open configuration, the engaging end 68 engages and displaces the valve member 32 into its open position. The tolerances that form the distance between the engaging end 68 and the valve member 32 are very important because, if this distance is too large, sequencing problems can occur that cause texture material to be dispensed in a poor pattern, especially if the trigger is pulled slowly.

In particular, ideally, the distance between the engaging end 68 and the valve member 32 will be zero when the valve member is in the closed position. A first preferred range for this distance is between 0.015" and −0.005" (where a negative number indicates that the valve member 32 is biased the given distance towards the open position). In any event, this distance should be less than 0.040" or relatively severe sequencing problems are likely to occur.

TO allow pressurized fluid to exit the valve chamber 36 and enter the fluid passageway 42, a plurality of slots 70 are formed in the engaging portion 66 of the actuator member 60 adjacent to the engaging end 68. As shown by arrows B in FIG. 5, pressurized air passes through the slots 70 on its way to the fluid passageway 42. With the valve member 32 in its open position, the air flowing through the slots 70 is substantially unobstructed.

The nozzle member 62 defines the nozzle portion 46 of the fluid passageway 42. In particular, an inner wall 72 of the nozzle member 62 is frustoconically shaped to form a reduced diameter portion that causes pressurized air to flow out of the fluid passageway 42 as appropriate for mixing with the texture material at the mixing location 56.

A forward portion 74 of the nozzle member 62 is adapted to engage the main housing assembly 26 in a manner that prevents product from flowing from the product chamber 58 into the mixing location 56 when the conduit assembly 30 is in the closed configuration. More specifically, the main housing assembly 26 comprises a front plate 78. This front plate 78 has a plurality of nozzle openings 80 of different diameters formed therein. The front plate 78 is rotatable such that any one of the nozzle openings 80 can be arranged adjacent to the mixing location 56. The different sized nozzle openings 80 result in different texture patterns.

When the conduit assembly 30 is in the closed configuration, the forward portion 74 of the nozzle member 78 engages the front plate 78 to prevent material from entering the mixing location 56. Additionally, the main housing assembly also comprises a housing 82 in which the nozzle opening 50 is formed. The forward portion 74 of the nozzle member 62 is adapted to fit within the nozzle opening 50 to block texture material from flowing from the product chamber 58 into the mixing location 56.

The main housing assembly 26 further comprises a trigger stop member 84. The trigger stop member 84 is adapted to engage a stop projection 86 extending from the trigger member 34. Additionally, the trigger stop member 84 is rotatably attached to the housing 82. By rotating a knob 88 (FIG. 1), the trigger stop member 84 can be rotated about an offset pivot point such that the rearmost location into which the trigger member 34 may be displaced can be varied. This allows the user to adjust the amount of texture material that enters the mixing location and thus the amount of texture material applied to the surface being coated.

The valve housing 28 is generally cylindrical but has a plurality of mounting surfaces 88 formed thereon. These mounting surfaces 88 engage mounting projections 90 formed on the housing 82 in a manner that prevents rotation of the valve housing 28 about its axis. In addition, the valve housing 28 comprises an internal threaded portion 92 into which an air hose or the like connected to an air compressor may be threaded to provide a supply of pressurized air in the valve chamber 36.

Figure 8:
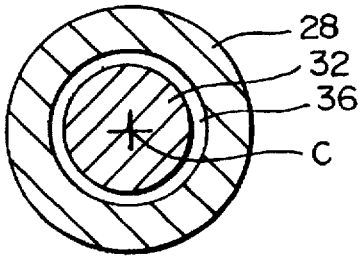
FIG. 8 is taken along lines 8—8 in FIG. 4.
Figure 9:
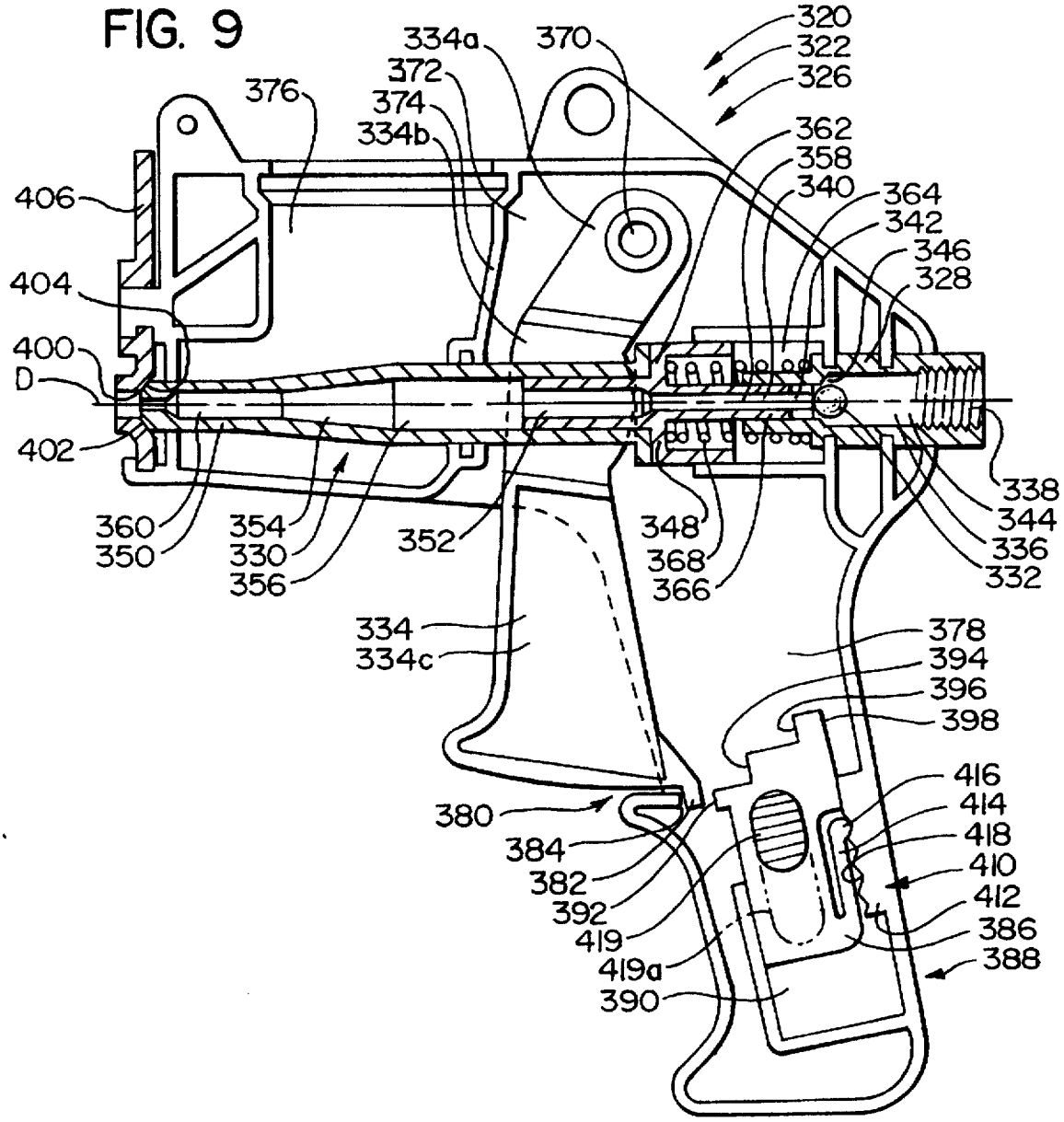
FIGS. 9, 10, 11, 12, and 13 are side, cut-away views of yet another exemplary device constructed in accordance with, and embodying, the principles of the present invention.

Referring now to FIG. 8, shown therein is the size relationship between the valve housing 28 and the valve member 32. In particular, a valve axis C shown in FIG. 8 corresponds to longitudinal axis of the valve housing 28. FIG. 8 shows that a cross-sectional area of the valve member 32 in a plane orthogonal to the valve axis C is less than the cross-sectional area of the valve chamber 36. Thus, pressurized fluid may flow around the valve member 32 when it is in the open position.

Referring again to FIGS. 4 and 5, it can be seen that the valve chamber 36 comprises a first portion 94, a second portion 96, and an intermediate portion 98. The first and second portions 94 and 96 are cylindrical, while the intermediate portion 98 is frustoconical, with the longitudinal axes of all of these portions 94, 96, and 98 being aligned along the valve axis C.

The cross-sectional area of the first portion 94 of the valve chamber 36 is smaller than that of the widest portion of the valve member 32 in a plane orthogonal to the valve axis. Thus, a frustoconical intermediate surface 100 of the valve housing 28 which defines the intermediate portion 98 forms a restriction which prevents the valve member 32 from entering the first portion of the valve chamber 36.

As mentioned above, the engaging portion 66 of the actuator member 60 extends at least partially into the first portion 94 of the valve chamber 36 and, when the conduit assembly 30 is in the open configuration, into at least the intermediate portion 98 and in some situations into the second portion 96 of the valve chamber 36. With the engaging portion 66 of the actuator member 60 so extending into the valve chamber intermediate and/or second portions 98 and 96, the valve member 32 is displaced into the open position.

The exemplary dispensing assembly 22 further comprises a spring member 102 arranged in the product chamber 58. This spring member 102 resiliently resists movement of the conduit assembly 30 from the closed configuration into the open configuration. Thus, when force on the trigger member 34 is removed, the spring member 102 will act on the conduit assembly 30 to force the conduit assembly back into the closed configuration.

The housing 82 discussed briefly above comprises an inner wall 104 that divides the main chamber 48 into the product chamber 58 and a trigger chamber 106. The conduit assembly 30 passes through the center wall 104, and an O ring 108 is placed around the actuator member 60 to form a seal between the member 60 and the center wall 104. This seal prevents texture material from entering into the trigger chamber.

Figure 6:
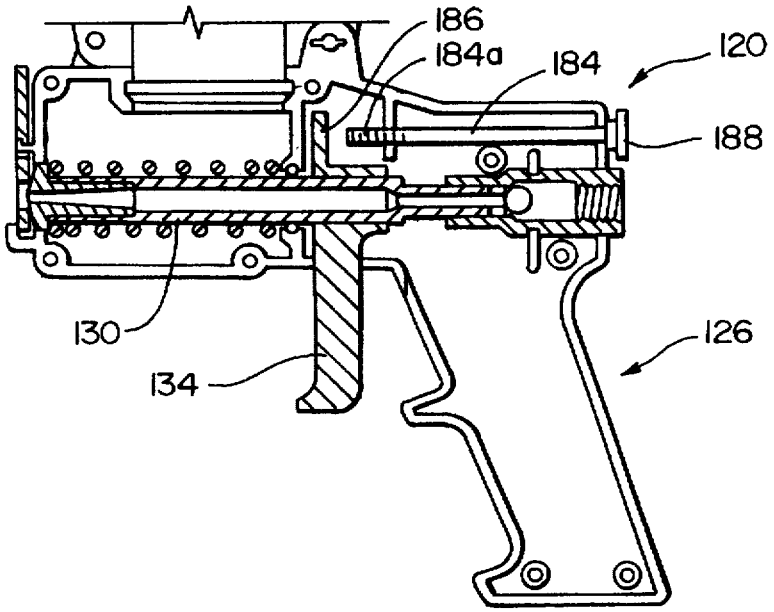
FIG. 6 shows a second exemplary hopper gun constructed in accordance with, and embodying, the principles of the present invention.

Referring now to FIG. 6, depicted therein at 120 is a second embodiment of a hopper gun constructed in accordance with, and embodying, the principles of the present invention. This hopper gun 120 is the same in almost every respect as the hopper gun 20 described above, so the hopper gun 120 will be described herein only to the extent that it differs from the hopper gun 20. In the following discussion, the same reference characters used above in the discussion of the hopper gun 20 will be used in the discussion of the hopper gun 120 with the exception that these reference characters will be increased by 100.

The primary difference between the hopper guns 120 and 20 is that the gun 120 has a screw-type trigger stop member 184. In particular, the stop member 184 has a knob 188 which extends out of the back of the main housing assembly 26 rather than the side thereof as did the knob 88 described above. Further, the stop member 184 is in the overall shape of a screw and has a threaded portion 184*a* that engages the main housing assembly 126 such that rotation of the stop member 184 about its axis causes forward and aft movement of the stop member 184 along its axis. Thus, the stop projection 186 on the trigger member 134 is limited based on the forward or aft position of the trigger member 184.

Figure 7:
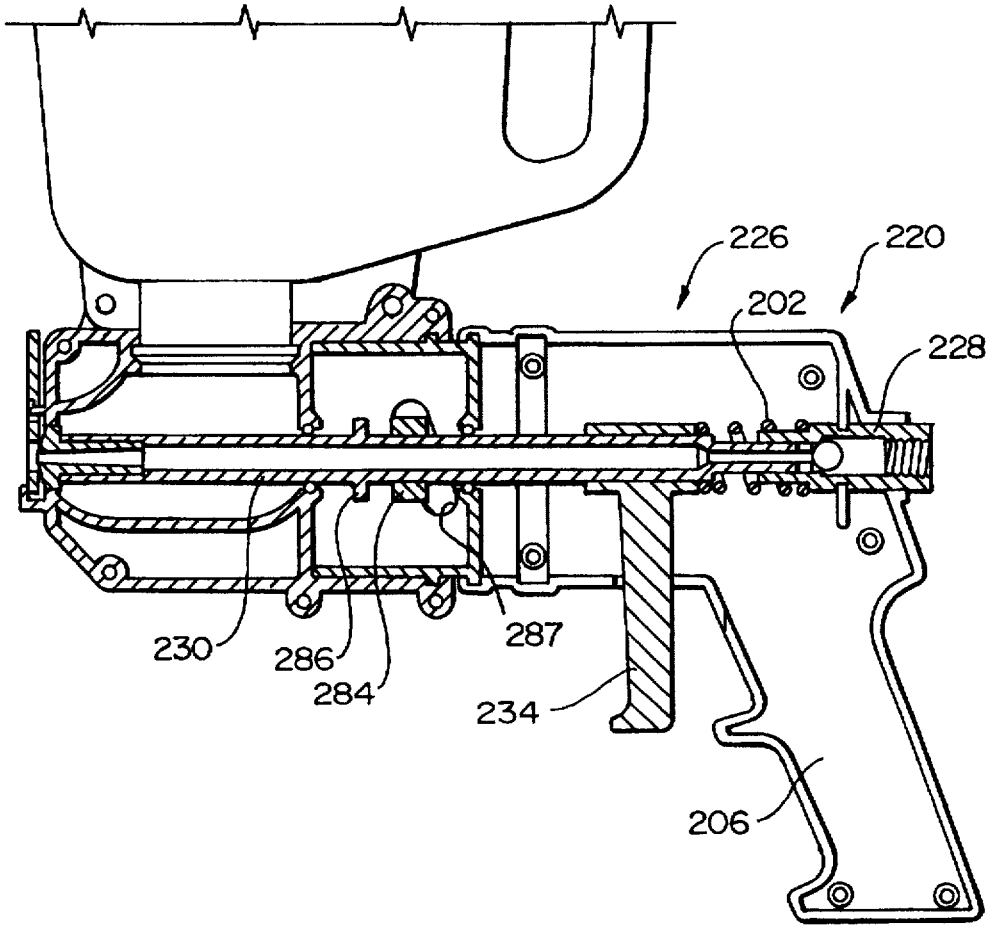
FIG. 7 depicts yet another spray gun constructed in accordance with the present invention.

Referring now to FIG. 7, depicted therein is yet another exemplary hopper gun constructed in accordance with, and embodying, the principles of the present invention. This hopper gun 220 is also constructed in the same basic manner as the hopper gun 20 described above. Again, only the differences between the hopper gun 220 and the gun 20 described above will be discussed below. In the case of the hopper gun 220, the same reference characters will be used but will be increased by 200 from those employed to describe the hopper gun 20.

The primary differences between the hopper gun 220 and the hopper gun 20 described above are in the mechanism for limiting rearward movement of the conduit assembly 230 and the placement of the spring 202 employed to bias the conduit assembly 230 into its closed configuration. In the hopper gun 220, a trigger stop member 284 is moved forward or aft by the action of a projection therefrom on an angled slot surface 287 on the main housing assembly 226. In this case, the stop projection 286 is formed on the conduit assembly 230 rather than the trigger member 234.

Additionally, with the hopper gun 220, the spring 202 thereof is arranged in the trigger chamber 206 and extends between the valve housing 228 and the trigger member 234 to bias the conduit assembly 230 into its closed configuration. Placement of the spring 202 in the trigger chamber 206 keeps the texture material away from the spring member 202.

Referring now to FIGS. 9–13, depicted therein is the construction and operation of yet another exemplary hopper gun 320 that is constructed in accordance with, and embodies, the principles of the present invention. For ease of illustration, the hopper itself is not shown in FIGS. 9 through 13. The hopper gun 320 operates in the same manner as the gun 20 described above.

The primary differences between the hopper gun 320 and the gun 20 described above are the method of limiting movement of the trigger member and the configuration and arrangement of the spring employed to bias the conduit assembly into the closed position.

The hopper gun 320 comprises dispensing assembly 322 having a main housing assembly 326, a valve housing 328, a conduit assembly 330, a valve member 332, and a trigger member 334.

The valve housing 328 defines a valve chamber 336 having a valve inlet 338 and a valve outlet 340. The valve housing 328 defines a valve axis D. The valve chamber 336 is symmetrically arranged along the valve axis D and has a first portion 342, a second portion 344, and an intermediate portion 346. The first and second portions 342 and 344 are cylindrical, and the intermediate portion 346 is frustoconical, with the axis of all of these portions being aligned with the valve axis D.

The conduit assembly 330 comprises an actuator member 348 and a nozzle member 350. The actuator member 348 defines a center bore 352, while the nozzle member 350 defines a center bore 354. The actuator member 348 mates with the nozzle member 350 such that the center bores 352 and 354 align to form a fluid passageway 356. The fluid passageway 356 has an inlet portion 358 and a nozzle portion 360.

The actuator member 348 further comprises a retaining portion 362, and the main housing assembly 326 defines a spring cavity 364. The retaining portion 362 of the actuator member 348 is snugly received within the portion of the main housing assembly 326 that defines the spring cavity 364. Additionally, an engaging portion 366 of the actuator member 348 is snugly received within a portion of the valve housing 328 that defines the first portion 342 of the valve chamber 336.

By nesting the retaining portion 362 within the spring cavity 364 and the actuator portion 366 within the first portion 342 of the valve chamber 336, a nearly fluid-tight seal is maintained between the various structural components to cause pressurized fluid within the valve chamber 336 to pass through the fluid passageway 356 when the valve member 332 is in the open position.

Additionally, a spring member 368 is arranged within the spring cavity 364 between the valve housing 328 and the actuator member 348. As the trigger member 334 is pulled to move the conduit assembly 330 out of the closed configuration, the spring member 368 is compressed. Then, when force is released from the trigger member 334, the spring expands to force the conduit assembly 330 back into the closed configuration.

The arrangement described above provides a reliable, easy to manufacture assembly that does not require the use of O rings to maintain pressure within the valve chamber.

The trigger member 334 of the exemplary hopper gun 320 is hinged to the main housing assembly 326 by a hinge pin 370. More specifically, the trigger member comprises an upper portion 334*a* through which the hinge pin 370 extends, an intermediate portion 334b that engages the conduit assembly 330, and a lower portion 334*c*. Applying a rearward force to the lower portion 334*c* of the trigger member 334 causes this member 334 to rotate about the hinge pin 370. Additionally, the intermediate portion 334*b* of trigger member 334 is configured such that rotation about the hinge pin 370 displaces the conduit assembly 330 rearwardly along the valve axis D.

The main housing assembly 326 defines a main chamber 372 and further comprises a center wall 374 that divides the main chamber 372 into a product chamber 376 and a trigger chamber 378. A trigger opening 380 is formed in the main housing assembly 326 that allows at least a portion of the trigger member 334 to enter the trigger chamber 378. When the conduit assembly 330 is in the closed configuration, at least a portion of the trigger member 334 extends through the trigger opening 380 into the trigger cavity 378. This eliminates a possible pinch point between the trigger member 334 and the main housing assembly 326.

Additionally, a stop projection 382 extends from the trigger member 334. This stop projection 382 engages the main housing assembly 326 at a location identified by reference character 384 to prevent the trigger member 334 from being rotated completely out of the trigger chamber 378.

The dispensing assembly 322 further comprises a trigger stop member 386 mounted within a handle portion 388 of the main housing assembly 326. The handle portion 388 is configured to fit the palm of the user's hand, thereby allowing the user to pull the trigger member 334 rearwardly.

The trigger stop member 386 is mounted within a stop cavity 390 defined by the handle portion 388 of the main housing assembly 326. The trigger stop member 386 is slideably mounted within the stop cavity 390 such that it may move between a plurality of stop positions as shown by a comparison of the locations of the stop member 386 in FIGS. 9–13.

Formed on the stop member 386 are first, second, and third stop surfaces 392, 394, and 396 and a lock surface 398. When the stop member 386 is in the first stop position shown in FIG. 9, the stop projection 384 on the trigger member 334 engages the first stop surface 392 after the trigger member is moved only a very short distance. This limits the rearward motion of the conduit assembly 330 to a first location, which in turn determines the size of a gap 400 between a nozzle surface 402 on the nozzle member 350 and a nozzle seat surface 404 formed on a front plate 406 of the main housing assembly 326. This gap 400 is zero in FIG. 9 because the conduit assembly 330 is in the closed configuration. When the stop member 386 is in the first stop position and the conduit assembly 330 is rearwardly displaced into the open configuration as far as possible (not shown in the drawings), the gap 400 is a first predetermined size and allows texture material within the product chamber 376 to reach a mixing location 408 (FIGS. 10–13) at a first predetermined flow rate.

Figure 10:
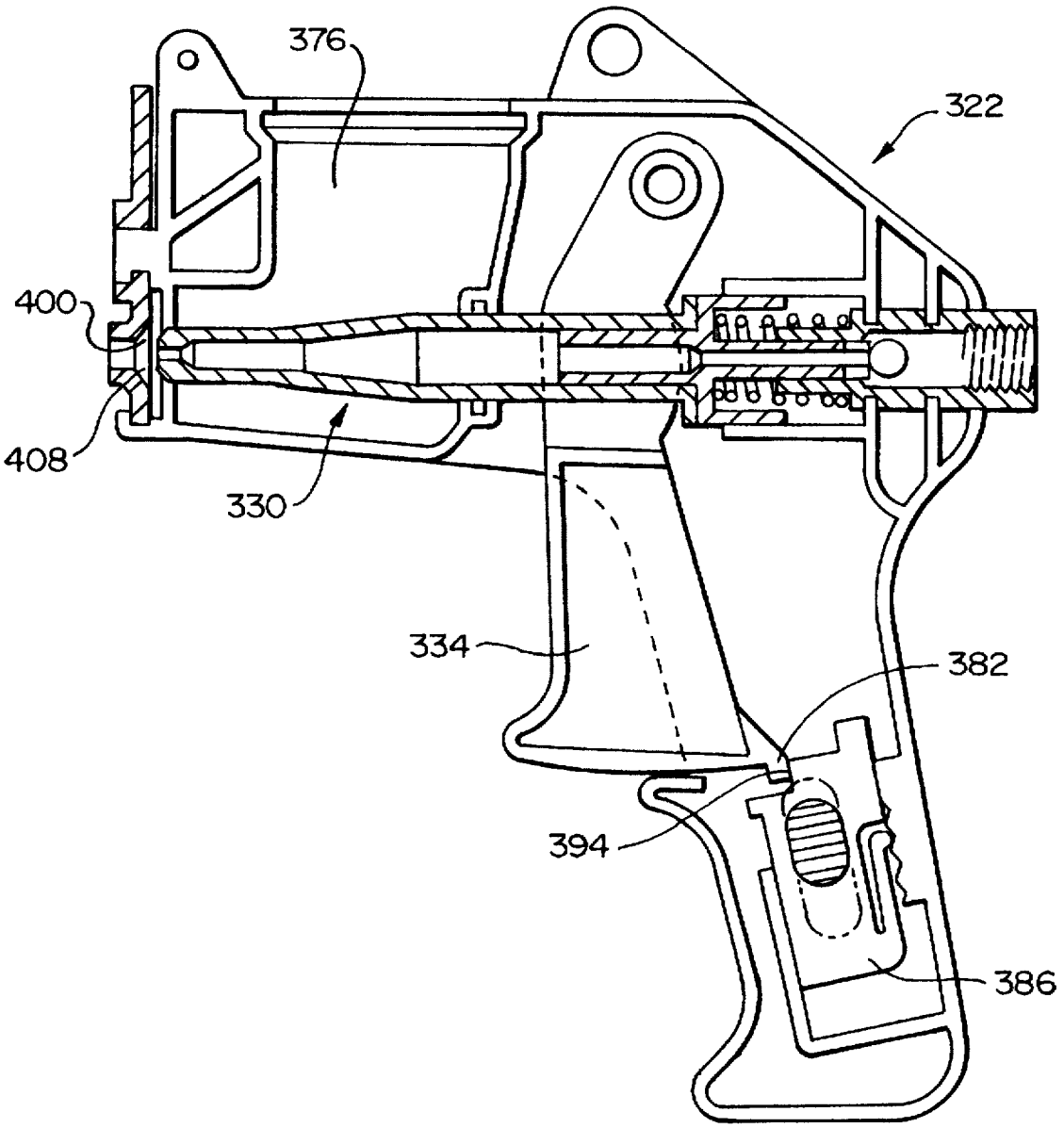

When the stop member 386 is in the second stop position shown in FIG. 10, the stop projection 384 on the trigger member 334 engages the second stop surface 394 as the trigger member 334 moves into the trigger cavity 378. When the stop member 386 is in the second stop position and the conduit assembly 330 is rearwardly displaced into the open configuration as far as possible (shown in FIG. 10), the gap 400 is of a second predetermined size and allows texture material within the product chamber 376 to reach the mixing location 408 at a second predetermined flow rate.

Figure 11:
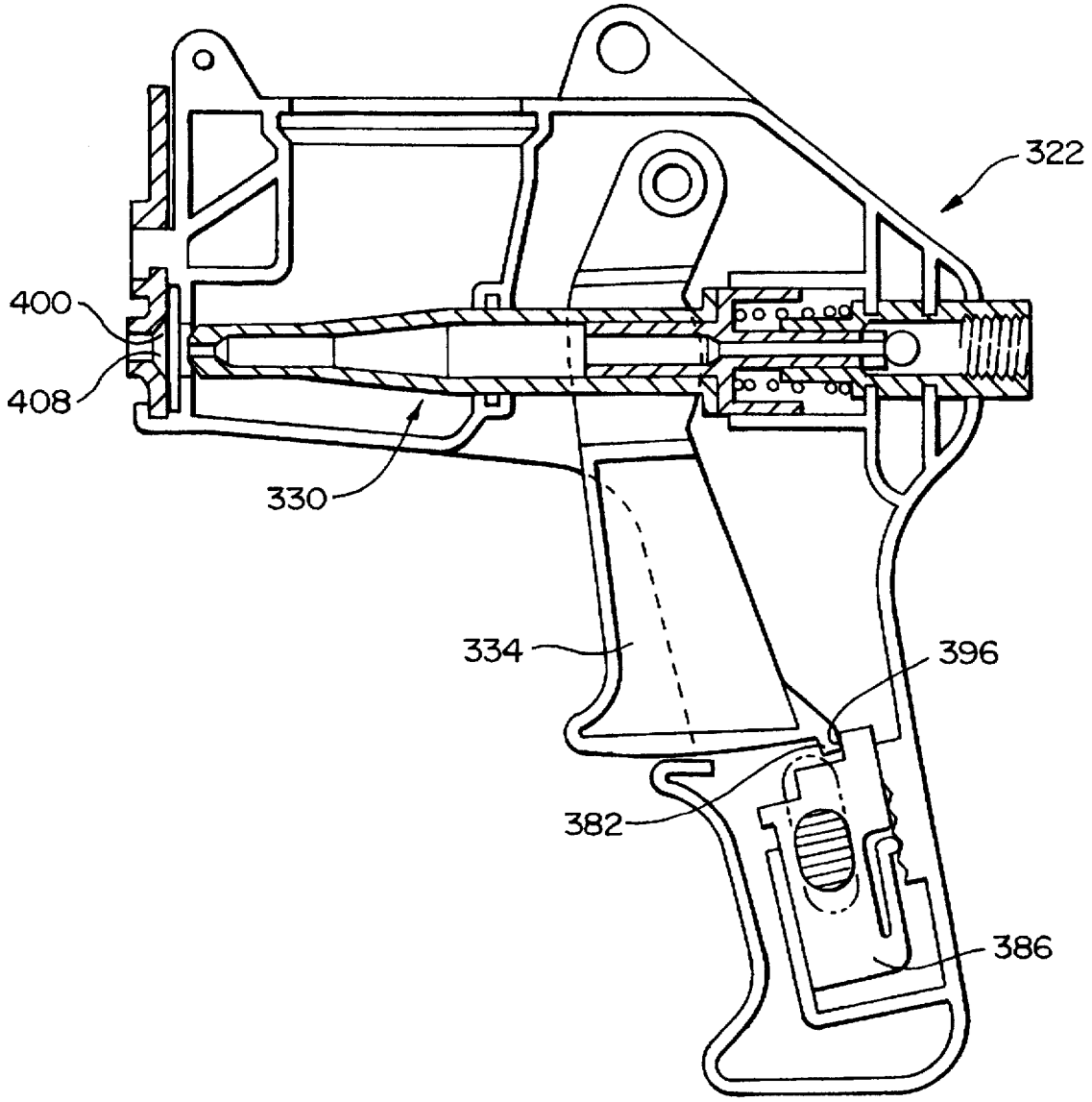

When the stop member 386 is in the third stop position shown in FIG. 11, the stop projection 384 on the trigger member 334 engages the third stop surface 396 as the trigger member 334 moves into the trigger cavity 378. When the stop member 386 is in the third stop position and the conduit assembly 330 is rearwardly displaced into the open configuration as far as possible (shown in FIG. 11), the gap 400 is of a third predetermined size and allows texture material within the product chamber 376 to reach the mixing location 408 at a third predetermined flow rate.

Figure 12:
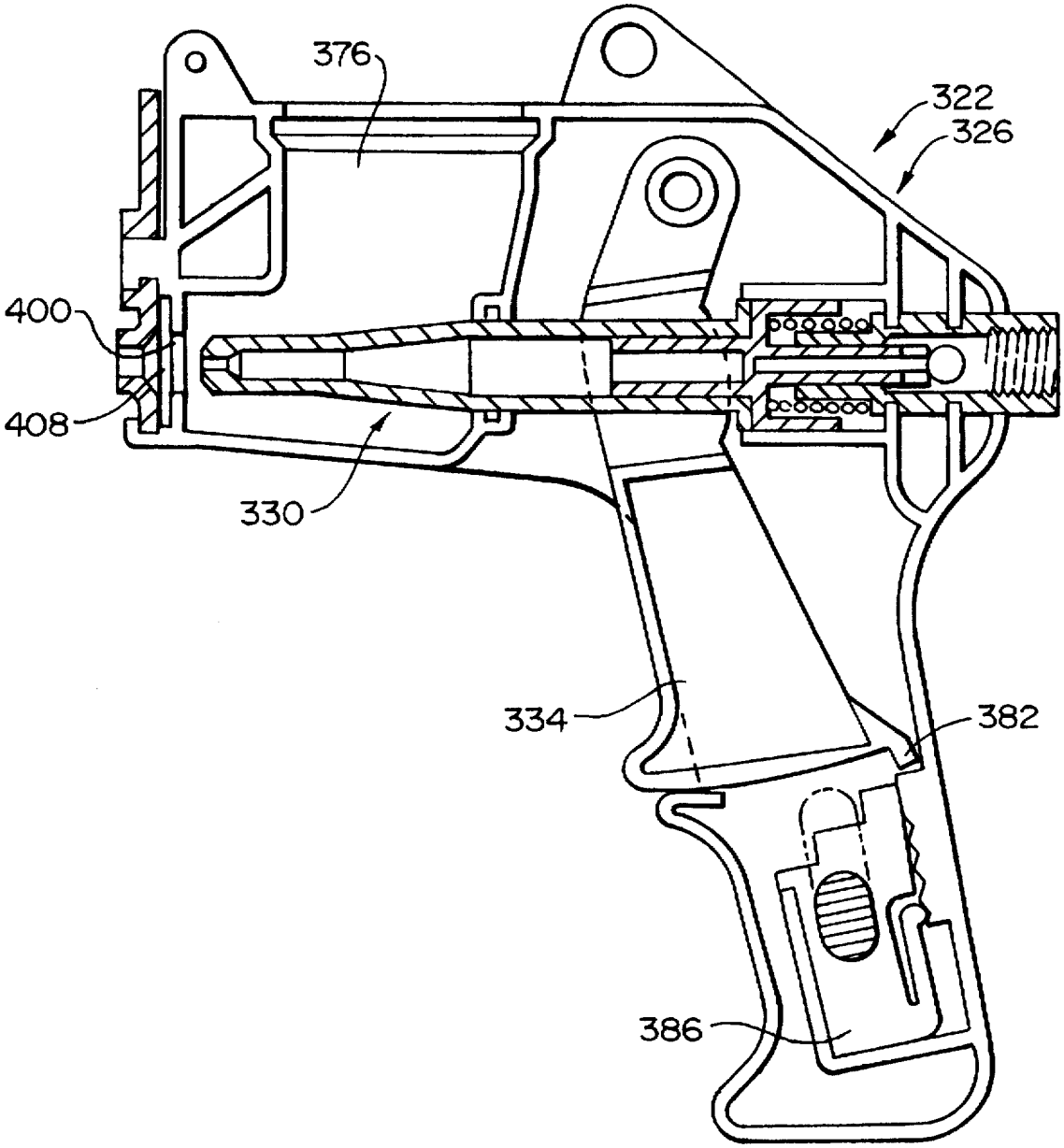

When the stop member 386 is in the fourth stop position shown in FIG. 12, the stop member 386 is removed from the path of movement of the stop projection 384, allowing the trigger member 334 to move back into the trigger cavity 378 until the stop projection 384 engages a portion of the main housing 328. When the stop member 386 is in the fourth stop position and the conduit assembly 330 is rearwardly displaced into the open configuration as far as possible (shown in FIG. 12), the gap 400 is of a fourth predetermined size and allows texture material within the product chamber 376 to reach the mixing location 408 at a fourth predetermined flow rate.

Figure 13:
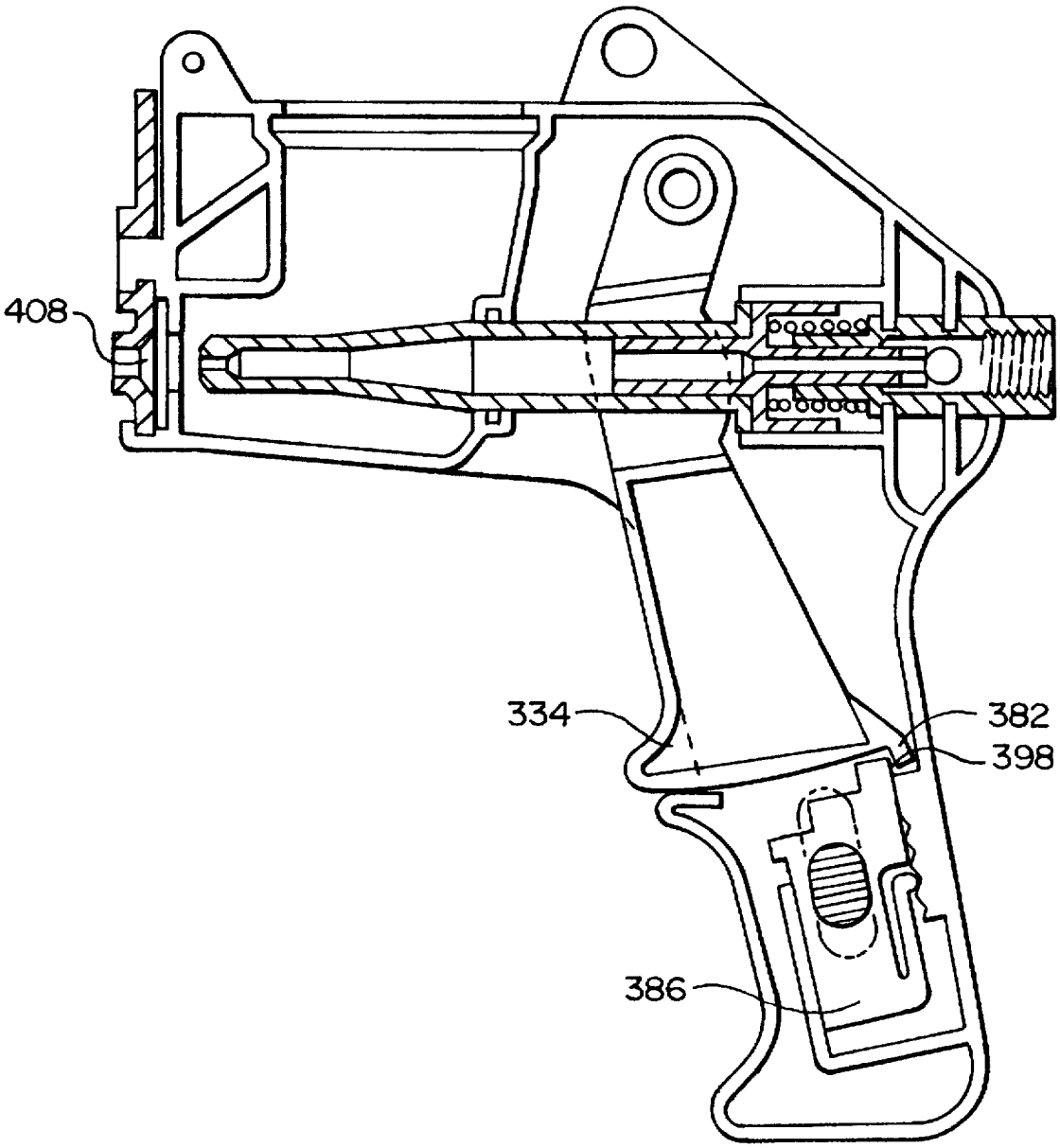

At that point, the stop projection 386 may be moved back into the third stop position as shown in FIG. 13 and the trigger member 334 released such that the stop projection 384 engages the lock surface 398 formed on the stop member 386. In this configuration, the trigger member 334 is locked in place such that texture material reaches the mixing location at approximately the fourth flow rate without any pressure being exerted on the trigger member 334.

The trigger stop arrangement of the present invention thus allows texture material to reach the mixing location and any one of four flow rates. This allows the user to select the rate at which texture material is applied to the surface being textured and to achieve the same rate consistently.

To hold the stop member 386 into the first through fourth stop locations, a detent locking system 410 (FIG. 9) is provided. This detent system 410 comprises a detent block 412 fixed to the main housing assembly 326 and a detent arm 414 formed on the stop member 386. The detent arm 414 is flexible and has a rounded engaging end 416. The detent block 412 has rounded grooves 418 formed thereon adapted to be engaged by the rounded end 416 of the detent arm 414.

When deliberate up or down forces are applied to the stop member 386, the grooves 418 act on the rounded end 416 to deform the detent arm 414 and allow the stop member 386 to move among the stop positions. However, the resiliency of the detent arm 414 biases the rounded ends 416 into the grooves 418 to prevent inadvertent movement of the stop member 386 out of the stop positions during use. A button 419 on the stop member 386 extends out of a slot 419*a* in the main housing assembly 326 to facilitate the movement of the stop member 386 through the stop locations.

While the exemplary dispensing device 322 is particularly adapted to include a valve member 332, it should be recognized that this device 322 could operate in a free-running manner without the valve member 332 and still obtain significant benefits in production costs and use.

Accordingly, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; all changes which come within the meaning and range of equivalency of the claims are therefore intended to be embraced therein.

I claim:

1. A fluid dispensing device for dispensing product comprising:

a main housing assembly defining a main chamber and nozzle, product, and fluid openings that allow fluid communication between an exterior of the main housing assembly and the main chamber;

a valve housing defining a valve chamber having a valve inlet and a valve outlet, the valve housing being arranged adjacent to the fluid opening and having an intermediate surface defining a portion of the valve chamber;

a fluid passageway having an inlet portion and a nozzle portion, where the inlet portion is in fluid communication with the valve outlet and the nozzle portion is located adjacent to a mixing location that is adjacent to the nozzle opening, where the fluid flows along the fluid passageway from the valve outlet to the mixing location;

a substantially spherical valve member disposed within the valve chamber, where pressurized fluid entering the valve inlet forces the valve member against the intermediate surface of the valve housing in a closed position to prevent pressurized fluid within the valve chamber from flowing out of the valve outlet and into the inlet portion; and actuator means operable between a closed configuration and an open configuration for allowing an operator to displace the valve member from the closed position into an open position to allow pressurized fluid in the valve chamber to flow out of the valve outlet, into the inlet portion, through the fluid passageway, out of the nozzle portion, and to the mixing location.

2. A fluid dispensing device as recited in claim 1, in which the actuator means comprises a conduit member that defines the fluid passageway.

3. A fluid dispensing device as recited in claim 2, in which the actuator means further comprises a trigger member connected to the conduit member such that displacement of the trigger member displaces the conduit member to vary the amount of product that reaches the mixing location.

4. A fluid dispensing device as recited in claim 3, further comprising stop means for stopping the trigger member at any one of a plurality of stop locations.

5. A fluid dispensing device as recited in claim 2, in which the conduit member engages an outlet portion of the main housing when the actuator means is in the closed configuration, where the conduit member prevents product from reaching the mixing location when the conduit member engages the outlet portion of the main housing.

6. A fluid dispensing device as recited in claim 1, further comprising product storage means for storing product, the product storage means being in fluid communication with main chamber through the product opening defined by the main housing assembly.

7. A fluid dispensing device as recited in claim 6, in which the product storage means is a hopper mounted above the main housing assembly such that the product is gravity fed into the main chamber.

8. A fluid dispensing device as recited in claim 2, in which the main housing assembly comprises a barrier wall that divides the main chamber into a product chamber and a trigger chamber, where the product and nozzle openings are located in the product chamber and the valve opening is located in the trigger chamber.

9. A fluid dispensing device as recited in claim 8, in which the barrier wall comprises a conduit opening through which the conduit member extends, the fluid dispensing device further comprising sealing means for inhibiting flow of product from the product chamber to the trigger chamber through the conduit opening.

10. A fluid dispensing device as recited in claim 1, further comprising resilient means for biasing the actuator means into the open configuration.

11. A fluid dispensing device as recited in claim 5, further comprising spring means interposed between the conduit member and the main housing assembly to bias the conduit member against the outlet portion of the main housing assembly.

12. A fluid dispensing device as recited in claim 4, in which:

the trigger member comprises an upper portion located within the main chamber, an intermediate portion attached to the conduit member, and a lower portion at least a portion of which extends out of a trigger opening formed in the main housing assembly; and the stop means is arranged within the main housing assembly to engage the lower portion of the trigger member.

13. A fluid dispensing device as recited in claim 12, in which:

the main housing assembly contains a handle portion configured for gripping;

when the trigger member is displaced to displace the conduit member and thereby place the actuating means into the open configuration, the lower portion of the trigger member moves into main chamber through the trigger opening; and at least a portion of the stop means engages the lower portion of the trigger member.

14. A fluid dispensing device as recited in claim 13, in which:

the stop means has a plurality of stepped stopping surfaces formed thereon; and the lower portion of the trigger member engages one of the stopping surfaces.

15. A fluid dispensing device as recited in claim 14, in which:

the main housing assembly comprises a stop member housing;

the stop means is movably disposed within the stop means housing; and which the stopping surface is engaged by the lower portion of the trigger is determined by the location of the stop means.

16. A fluid dispensing device as recited in claim 15, in which the stop means is movable among first, second, third, and fourth stopping positions, wherein each of these positions varies the position of the trigger member when the trigger member engages the stop means.

17. A fluid dispensing device as recited in claim 2, in which:

the valve chamber comprises first, second, and intermediate portions and defines a valve axis; and a diameter of the valve member is less than a diameter of the first portion of the valve chamber.

18. A fluid dispensing device as recited in claim 17, in which the diameter of the valve member is greater than a diameter of the second portion of the valve chamber.

19. A fluid dispensing device as recited in claim 18, in which:

the intermediate portion of the valve chamber is arranged between the first and second portions of the valve chamber; and the pressurized fluid forces valve member against an intermediate surface on the valve housing, where the intermediate surface on the valve housing defines the intermediate portion of the valve chamber.

20. A fluid dispensing device as recited in claim 19, in which an engaging portion of the conduit member extends through the valve outlet into the second portion of the valve chamber.

21. A fluid dispensing device as recited in claim 20, in which, when the actuator means is in the open configuration, the engaging portion of the conduit member extends into the intermediate portion of the valve chamber to dislodge the valve member from the intermediate surface.

22. A fluid dispensing device as recited in claim 21, in which the conduit member comprises perforations that allow pressurized fluid to flow through the fluid passageway when the valve member is dislodged from the intermediate surface.

23. A method of spraying product comprising the steps of:

providing a valve housing defining a valve chamber having a valve inlet a valve outlet, the valve housing comprising an intermediate surface defining a portion of the valve chamber;

providing a conduit member defining a fluid passageway having an inlet portion and a nozzle portion;

arranging the conduit member such that pressurized fluid flowing out of the valve chamber through the valve outlet enters the fluid passageway through the inlet portion;

disposing a substantially spherical valve member within the valve chamber;

introducing pressurized fluid into the valve chamber through the valve inlet such that the pressurized fluid acts on the valve member to hold the valve member against the intermediate surface in a closed position in which pressurized fluid is prevented from entering the fluid passageway through the inlet portion;

displacing the conduit member to move the valve member into an open position to allow pressurized fluid to enter the fluid passageway through the inlet portion.

24. A method as recited in claim 23, in which:

the valve chamber defines a valve axis and comprises first, second, and intermediate portions spaced along the valve axis; and a diameter of the valve member is less than a diameter of the first portion of the valve chamber.

25. A method as recited in claim 24, in which the diameter of the valve member is greater than a diameter of the second portion of the valve chamber.

26. A method as recited in claim 25, in which:

the intermediate portion of the valve chamber is arranged between the first and second portions of the valve chamber; and the pressurized fluid forces the valve member against an intermediate surface on a valve housing that defines the valve chamber, where the intermediate surface on the valve housing defines the intermediate portion of the valve chamber.

27. A method as recited in claim 26, in which an engaging portion of the conduit member extends through the valve outlet into the second portion of the valve chamber.

28. A fluid dispensing device as recited in claim 27, in which, when the conduit member is displaced to move the valve member, the engaging portion of the conduit member extends into the intermediate portion of the valve chamber to dislodge the valve member from the intermediate surface.

29. A method as recited in claim 28, further comprising the step of forming perforations in the engaging portion of the conduit member allow pressurized fluid to flow through the fluid passageway when the valve member is dislodged from the intermediate surface.

30. A fluid dispensing device for dispensing texture material comprising:

a main housing assembly defining a nozzle chamber, a trigger chamber, and nozzle, product, and air openings, where the nozzle and product openings allow fluid communication between an exterior of the main housing assembly and the nozzle chamber and the air opening allows fluid communication between the exterior of the main housing assembly and the trigger chamber;

a valve housing defining a valve chamber having a valve inlet and a valve outlet, the valve housing comprising a substantially frustoconical intermediate surface and being arranged within to the air opening, where the valve inlet is threaded to receive a threaded air hose fitting connected to a source of pressurized air;

a conduit assembly movable along the valve axis and defining an air passageway having an inlet portion and a nozzle portion, where the conduit assembly is arranged such that the inlet portion is in fluid communication with the valve outlet and the nozzle portion is located adjacent a mixing location that is adjacent the nozzle opening;

a substantially spherical valve member disposed within the valve chamber, where pressurized air entering the valve inlet forces the valve member against the intermediate surface of the valve housing in a closed position to prevent pressurized air within the valve chamber from flowing out of the valve outlet and into the inlet portion; and a trigger member movable between a forward position and a rearward position, where movement of the trigger member into the rearward position moves the conduit assembly to displace the valve member from the closed position into an open position in which pressurized air in the valve chamber is allowed to flow out of the valve outlet, into the inlet portion, through the air passageway, out of the nozzle portion, and to the mixing location.

31. A fluid dispensing device as recited in claim 30, in which:

the valve chamber comprises first, second, and intermediate portions, where the first and second portions are cylindrical and are coaxial with the valve axis, where the diameter of the first portion is greater than that of the second portion and the intermediate portion lies between the first and second portions; and the intermediate portion is defined by an intermediate surface on the valve housing; and the valve member engages the intermediate surface when in the valve member is in the closed position.

32. A fluid dispensing device as recited in claim 30, in which:

the valve chamber comprises first, second, and intermediate portions, where a cross-sectional area of the first portion is greater than that of the second portion in planes orthogonal to the valve axis and the intermediate portion lies between the first and second portions; and the valve member is sized and configured to reside within the first portion of the valve chamber such that pressurized air can flow around the valve member within the first portion of the valve chamber; and the intermediate portion of the valve chamber is sized and configured to prevent the valve member from entering the second portion of the valve chamber.

33. A fluid dispensing device as recited in claim 32, in which:

the conduit assembly comprises a nozzle member and an actuator member, the nozzle member and actuator member having center bores and being configured to mate such that the center bores form the air passageway;

the actuator member comprises an engaging portion sized and configured to fit snugly within the second portion of the valve chamber such that (a) the actuator member does not engage the valve member when the trigger member is in the forward position, (b) the engaging portion of the actuator member engages the valve member to hold the valve member in the open position when the trigger member is in the rearward position, and (c) substantially all of the pressurized air flowing through the valve chamber enters the air passageway when the valve member is in the open position.

34. A fluid dispensing device as recited in claim 30, further comprising a resilient member adapted to engage the main housing assembly and the trigger means to bias the trigger means into the forward position.

35. A fluid dispensing device as recited in claim 34, in which:

the conduit assembly comprises a retaining portion;

the main housing assembly defines a spring cavity adapted to receive the retaining portion of the conduit assembly;

the resilient member is arranged within the spring cavity to engage the retaining portion of the conduit assembly such that movement of the trigger member into the rearward position deforms the resilient member.

36. A fluid dispensing device for dispensing product comprising:

a main housing assembly defining a main chamber and nozzle, product, and fluid openings that allow fluid communication between an exterior of the main housing assembly and the main chamber;

a valve housing defining a valve chamber having a valve inlet and a valve outlet, the valve housing being arranged adjacent to the fluid opening;

a fluid passageway having an inlet portion and a nozzle portion, where the inlet portion is in fluid communication with the valve outlet and the nozzle portion is located adjacent to a mixing location that is adjacent to the nozzle opening, where the fluid flows along the fluid passageway from the valve outlet to the mixing location;

a valve member disposed within the valve chamber, where pressurized fluid entering the valve inlet forces the valve member against the valve housing in a closed position to prevent pressurized fluid within the valve chamber from flowing out of the valve outlet and into the inlet portion; and actuator means operable between a closed configuration and an open configuration for allowing an operator to displace the valve member from the closed position into an open position to allow pressurized fluid in the valve chamber to flow out of the valve outlet, into the inlet portion, through the fluid passageway, out of the nozzle portion, and to the mixing location, wherein the actuator means comprises a conduit member that defines the fluid passageway and a trigger member connected to the conduit member such that displacement of the trigger member displaces the conduit member to vary the amount of product that reaches the mixing location; and stop means for stopping the trigger member at any one of a plurality of stop locations; wherein the trigger member comprises an upper portion located within the main chamber, an intermediate portion attached to the conduit member, and a lower portion at least a portion of which extends out of a trigger opening formed in the main housing assembly; and the stop means is arranged within the main housing assembly to engage the lower portion of the trigger member.

37. A fluid dispensing device as recited in claim 36, in which:

the main housing assembly contains a handle portion configured for gripping;

when the trigger member is displaced to displace the conduit member and thereby place the actuating means into the open configuration, the lower portion of the trigger member moves into main chamber through the trigger opening; and at least a portion of the stop means engages the lower portion of the trigger member.

38. A fluid dispensing device as recited in claim 37, in which:

the stop means has a plurality of stepped stopping surfaces formed thereon; and the lower portion of the trigger member engages one of the stopping surfaces.

39. A fluid dispensing device as recited in claim 38, in which:

the main housing assembly comprises a stop member housing;

the stop means is movably disposed within the stop means housing; and which the stopping surface is engaged by the lower portion of the trigger is determined by the location of the stop means.

40. A fluid dispensing device as recited in claim 39, in which the stop means is movable among first, second, third, and fourth stopping positions, wherein each of these positions corresponds to one of the plurality of stop locations of the trigger member.

41. A fluid dispensing device for dispensing texture material comprising:

a main housing assembly defining a nozzle chamber, a trigger chamber, and nozzle, product, and air openings, where the nozzle and product openings allow fluid communication between an exterior of the main housing assembly and the nozzle chamber and the air opening allows fluid communication between the exterior of the main housing assembly and the trigger chamber;

a valve housing defining a valve chamber having a valve inlet and a valve outlet, the valve housing being arranged within to the air opening and the valve inlet being threaded to receive a threaded air hose fitting connected to a source of pressurized air;

a conduit assembly movable along the valve axis and defining an air passageway having an inlet portion and a nozzle portion, where the conduit assembly is arranged such that the inlet portion is in fluid communication with the valve outlet and the nozzle portion is located adjacent to a mixing location that is adjacent to the nozzle opening;

a valve member disposed within the valve chamber, where pressurized air entering the valve inlet forces the valve member against the valve housing in a closed position to prevent pressurized air within the valve chamber from flowing out of the valve outlet and into the inlet portion; and a trigger member movable between a forward position and a rearward position, where movement of the trigger member into the rearward position moves the conduit assembly to displace the valve member from the closed position into an open position in which pressurized air in the valve chamber is allowed to flow out of the valve outlet, into the inlet portion, through the air passageway, out of the nozzle portion, and to the mixing location; wherein the valve chamber comprises first, second, and intermediate portions, where a cross-sectional area of the first portion is greater than that of the second portion in planes orthogonal to the valve axis and the intermediate portion lies between the first and second portions; and the valve member is sized and configured to reside within the first portion of the valve chamber such that pressurized air can flow around the valve member within the first portion of the valve chamber;

the intermediate portion of the valve chamber is sized and configured to prevent the valve member from entering the second portion of the valve chamber;

the conduit assembly comprises a nozzle member and an actuator member, the nozzle member and actuator member having center bores and being configured to mate such that the center bores form the air passageway; and the actuator member comprises an engaging portion sized and configured to fit snugly within the second portion of the valve chamber such that (a) the actuator member does not engage the valve member when the trigger member is in the forward position, (b) the engaging portion of the actuator member engages the valve member to hold the valve member in the open position when the trigger member is in the rearward position, and (c) substantially all of the pressurized air flowing through the valve chamber enters the air passageway when the valve member is in the open position.

* * * * *